US009415444B2

(12) United States Patent
Kuniyoshi

(10) Patent No.: US 9,415,444 B2
(45) **Date of Patent: *Aug. 16, 2016**

(54) PROCESS FOR PRODUCTION OF R-T-B BASED SINTERED MAGNETS AND R-T-B BASED SINTERED MAGNETS

(75) Inventor: Futoshi Kuniyoshi, Osaka (JP)

(73) Assignee: HITACHI METALS, LTD., Tokyo (JP)

( * ) Notice: Subject to any disclaimer, the term of this patent is extended or adjusted under 35 U.S.C. 154(b) by 142 days.

This patent is subject to a terminal disclaimer.

(21) Appl. No.: 13/382,587

(22) PCT Filed: Jul. 12, 2010

(86) PCT No.: PCT/JP2010/061776

§ 371 (c)(1),
(2), (4) Date: Jan. 6, 2012

(87) PCT Pub. No.: WO2011/007758

PCT Pub. Date: Jan. 20, 2011

(65) Prior Publication Data

US 2012/0112863 A1 May 10, 2012

(30) Foreign Application Priority Data

Jul. 15, 2009 (JP) ..... 2009-166488

(51) Int. Cl.
*H01F 41/02* (2006.01)
*H01F 7/02* (2006.01)
(Continued)

(52) U.S. Cl.
CPC . *B22F 3/24* (2013.01); *C22C 19/07* (2013.01); *C22C 28/00* (2013.01);
(Continued)

(58) Field of Classification Search
CPC ..... H01F 1/0577; H01F 41/0293
USPC ..... 148/122
See application file for complete search history.

(56) References Cited

U.S. PATENT DOCUMENTS 5,383,978 A 1/1995 Yamamoto et al.
2008/0223489 A1* 9/2008 Nagata et al. ..... 148/101
(Continued)

FOREIGN PATENT DOCUMENTS

JP 2004-296973 A 10/2004
JP 2007-258455 A 10/2007
(Continued)

OTHER PUBLICATIONS

Machine translation of JP2007-258455. Oct. 2007.*
(Continued)

*Primary Examiner* — Jie Yang
*Assistant Examiner* — Xiaowei Su
(74) *Attorney, Agent, or Firm* — Keating & Bennett, LLP

(57) ABSTRACT

A method for producing a sintered R-T-B based magnet includes the steps of: providing a sintered R-T-B based magnet body 1; providing an RH diffusion source 2 including a metal or an alloy of a heavy rare-earth element RH (which is at least one of Dy an Tb); loading the sintered magnet body 1 and the RH diffusion source 2 into a processing chamber 3 so that the magnet body 1 and the diffusion source 2 are movable relative to each other and brought close to, or in contact with, each other; and performing an RH diffusion process by conducting a heat treatment on the sintered R-T-B based magnet body 1 and the RH diffusion source 2 at a temperature of 500° C. to 850° C. for at least 10 minutes while moving the magnet body 1 and the diffusion source 2 either continuously or discontinuously in the processing chamber 3.

5 Claims, 3 Drawing Sheets

(51) Int. Cl.

| | |
|---|---|
| ***B22F 3/24*** | (2006.01) |
| ***C22C 28/00*** | (2006.01) |
| ***C22C 33/02*** | (2006.01) |
| ***C22C 19/07*** | (2006.01) |
| ***C22C 38/00*** | (2006.01) |
| ***C22F 1/10*** | (2006.01) |
| ***C22F 1/16*** | (2006.01) |
| *H01F 1/057* | (2006.01) |

(52) U.S. Cl.

CPC ..... *C22C 33/0278* (2013.01); *C22C 38/005* (2013.01); *C22F 1/10* (2013.01); *C22F 1/16* (2013.01); *H01F 41/0293* (2013.01); *B22F 2003/241* (2013.01); *C22C 2202/02* (2013.01); *H01F 1/0577* (2013.01)

(56) References Cited

U.S. PATENT DOCUMENTS

2008/0286595 A1 11/2008 Yoshimura et al.
2010/0182113 A1* 7/2010 Yoshimura et al. ..... 335/302
2011/0012699 A1* 1/2011 Odaka et al. ..... 335/302
2011/0205006 A1* 8/2011 Odaka et al. ..... 335/302

FOREIGN PATENT DOCUMENTS

JP 2009-043776 A 2/2009
JP 2009-194262 A 8/2009

OTHER PUBLICATIONS

Machine translation of JP2004-296973. Oct. 2004.*
STIC translation of JP2004-296973A. Oct. 2004.*
Zirconia-Preciball (http://www.preciball.com/images/stories/preciball/Ceramic-grinding-media.pdf). 2008.*
English translation of Official Communication issued in corresponding International Application PCT/JP2010/061776, mailed on Feb. 16, 2012.
Official Communication issued in International Patent Application No. PCT/JP2010/061776, mailed on Sep. 14, 2010.

* cited by examiner

PROCESS FOR PRODUCTION OF R-T-B BASED SINTERED MAGNETS AND R-T-B BASED SINTERED MAGNETS

TECHNICAL FIELD

The present invention relates to a method for producing a sintered R-T-B based magnet including an $R_2T_{14}B$ type compound (where R is a rare-earth element and T is a transition metallic element including Fe) as a main phase. More particularly, the present invention relates to a method for producing a sintered R-T-B based magnet, which includes a light rare-earth element RL (which is at least one of Nd and Pr) as a major rare-earth element R and in which a portion of the light rare-earth element RL is replaced with a heavy rare-earth element RH (which is at least one element selected from the group consisting of Dy and Tb).

BACKGROUND ART

A sintered R-T-B based magnet, including an $Nd_2Fe_{14}B$ type compound phase as a main phase, is known as a permanent magnet with the highest performance, and has been used in various types of motors such as a voice coil motor (VCM) for a hard disk drive and a motor for a hybrid car and in numerous types of consumer electronic appliances. As Nd may be partially or entirely replaced with another rare-earth element R and as Fe may be partially replaced with another transition metallic element, the $Nd_2Fe_{14}B$ type compound is sometimes represented as an $R_2T_{14}B$ type compound. B may also be partially replaced with C (carbon).

As a sintered R-T-B based magnet loses its coercivity at high temperatures, such a magnet will cause an irreversible flux loss when exposed to high temperatures. For that reason, when used in a motor, for example, the magnet should maintain coercivity that is high enough even at elevated temperatures to minimize the irreversible flux loss. To realize that, the coercivity of the magnet at an ordinary temperature needs to be increased or the rate of variation in coercivity to a required temperature needs to be decreased.

It has been known that if Nd that is the light rare-earth element RL in the $R_2T_{14}B$ type compound phase is replaced with a heavy rare-earth element RH (which may be Dy and/or Tb), the coercivity will increase. It has been believed to be effective to add such a heavy rare-earth element RH as much as possible to the material alloy of a sintered R-T-B based magnet to achieve high coercivity at high temperatures. However, if the light rare-earth element RL (which may be at least one of Nd and Pr) is replaced with the heavy rare-earth element RH in a sintered R-T-B based magnet, the coercivity certainly increases but the remanence decreases instead. Furthermore, as the heavy rare-earth element RH is one of rare natural resources, its use is preferably cut down.

For these reasons, various methods for increasing the coercivity of a sintered R-T-B based magnet effectively with the addition of as small an amount of the heavy rare-earth element RH as possible have recently been researched and developed in order to avoid decreasing the remanence. The applicant of the present application already disclosed, in Patent Document No. 1, a method for diffusing a heavy rare-earth element RH inside of a sintered magnet body of an R—Fe—B based alloy while supplying the heavy rare-earth element RH onto the surface of the sintered magnet body (which will be referred to herein as an "evaporation diffusion process"). According to Patent Document No. 1, inside of a processing chamber made of a refractory metallic material, the sintered R-T-B based magnet body and an RH bulk body are arranged so as to face each other with a predetermined gap left between them. The processing chamber includes a member for holding multiple sintered R-T-B based magnet bodies and a member for holding the RH bulk body. A method that uses such an apparatus requires a series of process steps of arranging the RH bulk body in the processing chamber, introducing a holding member and a net, putting the sintered magnet bodies on the net, mounting the holding member and the net on the sintered magnet bodies, putting the upper RH bulk body on the net, and sealing the processing chamber hermetically and carrying out an evaporation diffusion.

Patent Document No. 2 discloses that in order to improve the magnetic properties of an Nd—Fe—B based intermetallic compound magnetic material, a powder of Yb metal with a low boiling point and a sintered Nd—Fe—B based magnet compact are sealed and heated in a thermally resistant hermetic container, thereby depositing uniformly a coating of Yb metal on the surface of the sintered magnet compact and diffusing a rare-earth element inside of the sintered magnet from that coating (see, in particular, Example #5 of Patent Document No. 2).

CITATION LIST

Patent Literature

Patent Document No. 1: PCT International Application Publication No. 2007/102391

Patent Document No. 2: Japanese Patent Application Laid-Open Publication No. 2004-296973

SUMMARY OF INVENTION

Technical Problem

According to the method of Patent Document No. 1, however, sintered R-T-B based magnet bodies and an RH bulk body of a heavy rare-earth element RH need to be arranged in a processing chamber so as to be spaced apart from each other. That is why it takes a lot of time and trouble to perform the arranging process step and its mass productivity is inferior to other methods. In addition, since Dy or Tb needs to be supplied by subliming it, it takes a long time to achieve higher coercivity by increasing the rate of diffusion of the heavy rare-earth element RH into the sintered R-T-B based magnet body. Among other things, Tb has a lower saturated vapor pressure than Dy, and therefore, it is particularly difficult to increase its rate of diffusion sufficiently.

On the other hand, according to the method of Patent Document No. 2, if the rare-earth metal in question has as high a saturated vapor pressure as Yb, Eu or Sm, deposition of its coating onto the sintered R-T-B based magnet body and diffusion of that element from the coating can be done by carrying out a heat treatment within the same temperature range (e.g., 800° C. to 850° C.). However, according to Patent Document No. 2, to sorb a rare-earth element with a low vapor pressure such as Dy or Tb, the rare-earth metal should be heated selectively to high temperatures by performing an inductive heating process using an RF heating coil. And to heat such a sorption source of Dy or Tb to a higher temperature than the sintered magnet body, the sorption source and the magnet body should be spaced apart from each other, thus causing a similar problem to that of the method disclosed in Patent Document No. 1. Also, according to the basic technical idea and method of Patent Document No. 2, a thick coating of Dy or Tb is deposited (to several ten μm or more, for example) on the surface of the sintered magnet body. Then, Dy or Tb will diffuse and enter the inside of main phase crystal grains in the vicinity of the surface of the sintered magnet body, thus causing a decrease in remanence.

It is therefore an object of the present invention to provide a method for producing a sintered R-T-B based magnet, of which the process step of diffusing a heavy rare-earth element RH such as Dy or Tb inside of a sintered magnet body through its surface without decreasing the remanence does contribute to mass production.

Solution to Problem

A method for producing a sintered R-T-B based magnet according to the present invention includes the steps of: providing a sintered R-T-B based magnet body; providing an RH diffusion source including a metal or an alloy of a heavy rare-earth element RH (which is at least one of Dy an Tb); loading the sintered R-T-B based magnet body and the RH diffusion source into a processing chamber so that the magnet body and the diffusion source are movable relative to each other and brought close to, or in contact with, each other; and performing an RH diffusion process by conducting a heat treatment on the sintered R-T-B based magnet body and the RH diffusion source at a temperature of 500° C. to 850° C. for at least 10 minutes while moving the magnet body and the diffusion source either continuously or discontinuously in the processing chamber.

In one preferred embodiment, the RH diffusion process includes rotating the processing chamber.

In this particular preferred embodiment, the RH diffusion process includes rotating the processing chamber at a surface velocity of at least 0.01 m/s.

In another preferred embodiment, in the RH diffusion process, the heat treatment is carried out with the internal pressure of the processing chamber adjusted to 100 kPa or less.

In still another preferred embodiment, in the RH diffusion process, the heat treatment is carried out by heating the processing chamber so that both the sintered R-T-B based magnet body and the RH diffusion source are heated.

Advantageous Effects of Invention

According to the present invention, even if the diffusion process temperature is lower than the conventional one and if the atmospheric gas pressure is relatively high, a heavy rare-earth element RH such as Dy or Tb can still be diffused inside of a sintered magnet body through its surface. In addition, according to the present invention, by rotating, rocking or shaking the processing chamber during the diffusion process, it is possible to prevent the diffusion source from melting under the heat and sticking to the sintered magnet body. On top of that, according to the present invention, there is no need to arrange the diffusion source and the sintered magnet body carefully at their predetermined positions in the processing chamber. As a result, the diffusion source and the sintered magnet body can be loaded much more easily and high mass productivity is realized.

DESCRIPTION OF EMBODIMENTS

Figure 1:
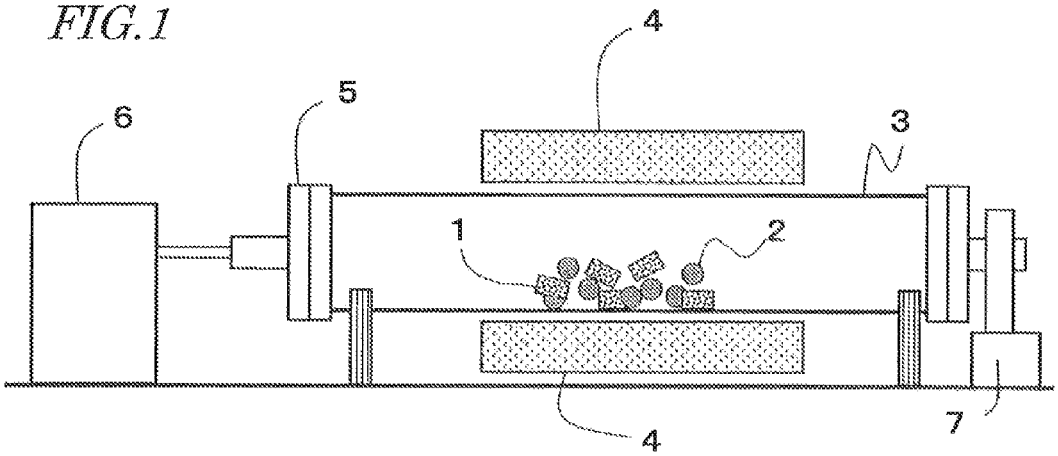
FIG. 1 is a cross-sectional view schematically illustrating a configuration for a diffusion system for use in a preferred embodiment of the present invention.

According to the manufacturing process of the present invention, a sintered R-T-B based magnet body and an RH diffusion source are loaded into a processing chamber (or a processing container) so as to be movable relative to each other and located close to, or in contact with, each other, and then are heated to, and maintained at, a temperature of 500° C. to 850° C. In this case, by rotating, rocking or shaking the processing chamber, the sintered R-T-B based magnet body and the RH diffusion source are moved either continuously or discontinuously in the processing chamber, thereby changing the point of contact between the sintered R-T-B based magnet body and the RH diffusion source. At the same time, the heavy rare-earth element RH vaporized (sublimed) can not only be supplied onto the surface of the sintered magnet body but also be diffused inside the sintered magnet body simultaneously while the sintered R-T-B based magnet body and the RH diffusion source are either brought close to, or spaced part from, each other. This process step will be referred to herein as an "RH diffusion process step".

In that temperature range of 500° C. to 850° C., a rare-earth element can certainly diffuse in a sintered R-T-B based magnet but Dy or Tb is not easily vaporized or sublimed. However, when the present inventors carried out a heat treatment while bringing the RH diffusion source into contact with the sintered R-T-B based magnet body (which will be sometimes simply referred to herein as a "sintered magnet body") in the processing chamber, we discovered, to our surprise, that the heavy rare-earth element RH did diffuse inside of the sintered magnet body and did contribute to increasing its coercivity. The diffusion could be produced successfully in such a temperature range probably because the distance between the RH diffusion source and the sintered magnet body decreased sufficiently by bringing them either close to each other or in contact with each other.

Nevertheless, if the RH diffusion source and the sintered magnet body were maintained at a temperature of 500° C. to 850° C. while being fixed at the same position and kept in contact with each other for a long time, then the RH diffusion source would stick to the surface of the sintered magnet body, which is a problem. Also, if the heat treatment were carried on while keeping them close to each other for a long time, then an excessive amount of heavy rare-earth element RH would be supplied onto the surface of the sintered magnet body, thus forming an RH coating there. As a result, the remanence $B_r$ would decrease as in Patent Document No. 2. Thus, to overcome such problems, according to the present invention, the sintered magnet body and the RH diffusion source are loaded in advance into a processing chamber so as to be movable relative to each other and be brought close to, or in contact with, each other, and then moved either continuously or discontinuously in the processing chamber, thereby avoiding such sticking and getting the RH diffusion done as intended. That is to say, by loading the sintered R-T-B based magnet body and the RH diffusion source into the processing chamber and moving them inside the chamber as described above, it is possible to prevent the RH diffusion source and the sintered magnet body from being fixed at the same position and kept in contact or close to each other for a long time. As a result, the RH diffusion process can be carried out while changing the point of contact between the RH diffusion source and the sintered magnet body either continuously or discontinuously or bringing the RH diffusion source and the sintered magnet body either close to, or spaced apart from, each other.

It should be noted that according to the present invention, to "load a sintered magnet body and an RH diffusion source into a processing chamber so as to be movable relative to each other and be brought close to, or in contact with, each other" means loading the sintered magnet body and the RH diffusion source so as to prevent the RH diffusion source and the sintered magnet body from being fixed at the same position and kept in contact with, close to, each other for a long time (e.g., at 850° C. for two minutes or more) by moving the sintered magnet body and the RH diffusion source in the processing chamber either continuously or discontinuously in the RH diffusion process after the loading process as described above. That is why according to the present invention, there is no need to arrange the sintered magnet body and the RH diffusion source at predetermined positions unlike the method disclosed in Patent Document No. 1.

As for a method for moving the sintered magnet body and the RH diffusion source in the processing chamber either continuously or discontinuously during the RH diffusion process, as long as the RH diffusion source and the sintered magnet body can have their point of contact changed either continuously or discontinuously or can be brought close to, or spaced apart from, each other without making the sintered magnet body chip or fracture, the processing chamber may be rotated, rocked or subjected to externally applied vibrations as described above, stirring means may be provided in the processing chamber, or any of various other methods may be used as well.

According to the present invention, even though the temperature is maintained in such a low range of 500° C. to 850° C., the RH supply source and the sintered magnet body can be kept close to, or in contact with, each other. As a result, the heavy rare-earth element RH that has sublimed from the RH diffusion source can be supplied onto the sintered magnet body effectively and can be diffused inside of the sintered magnet body through the grain boundary.

According to the conventional method in which a film of a heavy rare-earth element RH (which will be referred to herein as an "RH film") is formed on the surface of a sintered magnet body and then the heavy rare-earth element RH is diffused inside of the sintered magnet body through a heat treatment, the heavy rare-earth element RH diffusing will enter the inside of main phase crystal grains in a surface region that contacts with the RH film. As a result, the coercivity $H_{cJ}$ certainly increases but the remanence $B_r$ decreases instead. On the other hand, according to the present invention, the heavy rare-earth element RH that has traveled through the space to reach the surface of the magnet quickly penetrates into the inside of the sintered magnet body through a grain boundary diffusion, and therefore, such a film of the heavy rare-earth element RH is never formed on the surface of the sintered magnet body. Consequently, even in the surface region of the sintered magnet body, the heavy rare-earth element RH diffusing hardly enters the inside of the main phase crystal grains, and the coercivity $H_{cJ}$ can be increased effectively with the decrease in remanence $B_r$ minimized.

In addition, by vaporizing (subliming) and directly supplying the heavy rare-earth element RH and diffusing the heavy rare-earth element RH inside of the sintered magnet body at the same time with the point of contact between the RH diffusion source and the sintered magnet body changed by rotating or rocking the processing chamber or externally applying vibrations to the processing chamber, the time it would otherwise take to arrange the RH diffusion source and the sintered magnet body at predetermined positions can be saved.

If the magnetocrystalline anisotropy of a sintered R-T-B based magnet is increased on the outer periphery of its main phase crystal grains, the coercivity $H_{cJ}$ of the entire main phase increases effectively. According to the present invention, a heavy rare-earth element replaced layer can be formed on the outer periphery of the main phase not just in a region close to the surface of the sintered magnet body but also in a region deep under the surface of the sintered magnet body. That is why by forming such a layer including the heavy rare-earth element RH in an increased concentration efficiently on the outer periphery of the main phase over the entire sintered magnet body, not just the coercivity $H_{cJ}$ can be inueased but also the remanence $B_r$ hardly decreases because a portion with a low heavy rare-earth element RH concentration remains in the core of the main phase.

As can be seen easily from the foregoing description, according to the present invention, the heavy rare-earth element RH does not always have to be added to the sintered R-T-B based magnet body yet to be subjected to the RH diffusion process. That is to say, a known sintered R-T-B based magnet body, including a light rare-earth element RL (which is at least one of Nd and Pr) as a rare-earth element R, is provided and the heavy rare-earth element RH is diffused inside of the magnet from its surface. According to the conventional method in which a film of a heavy rare-earth element is formed on the surface of a magnet, it is difficult to diffuse the heavy rare-earth element RH deep inside of the magnet without causing a decrease in remanence $B_r$. However, according to the present invention, by producing a grain boundary diffusion of the heavy rare-earth element RH, the heavy rare-earth element RH can also be supplied efficiently to the outer periphery of the main phase that is located deep inside of the sintered magnet body. The present invention is naturally applicable to a sintered R-T-B based magnet in which the heavy rare-earth element RH has already been added to either its material alloy or the sintered R-T-B based magnet body yet to be subjected to the RH diffusion process. However, if a lot of heavy rare-earth element RH were added to the material alloy or the sintered R-T-B based magnet body yet to be subjected to the RH diffusion process, the effects of the present invention would not be achieved sufficiently. That is why a relatively small amount of the heavy rare-earth element RH should be added in that case.

Sintered R-T-B Based Magnet Body

First of all, according to the present invention, a sintered R-T-B based magnet body in which the heavy rare-earth element RH needs to diffuse is provided. The sintered magnet body has a composition including:

- 12 to 17 at % of a rare-earth element R;
- 5 to 8 at % of B (a portion of which may be replaced with C);
- 0 to 2 at % of an additive element M (which is at least one element selected from the group consisting of Al, Ti, V, Cr, Mn, Ni, Cu, Zn, Ga, Zr, Nb, Mo, Ag, In, Sn, Hf, Ta, W, Pb and Bi); and
- T (which is a transition metal consisting mostly of Fe but which may include Co) and inevitable impurities as the balance.

In this case, most of the rare-earth element R is at least one element that is selected from the light rare-earth elements RL but that may include a heavy rare-earth element as well. The heavy rare-earth element preferably includes at least one of Dy and Tb.

A sintered R-T-B based magnet body with the composition described above is produced by any arbitrary manufacturing process but may be made by the following manufacturing process, for example.

Material Alloy

First of all, an alloy, of which the composition has been adjusted to obtain a sintered magnet body with the composition described above eventually, is provided. Such an alloy is preferably made by quenching a melt of the material alloy by strip casting process, for example. Hereinafter, a method of making a rapidly solidified alloy by strip casting process will be described.

First, raw materials are mixed together to satisfy the predetermined composition. And the mixture is melted by an induction heating process within an argon atmosphere to make a melt of the material alloy. Next, this melt is kept heated at about 1350° C. and then quenched by single roller process, thereby obtaining a flake-like alloy block with a thickness of about 0.3 mm. Then, the alloy block thus obtained is pulverized into flakes with a size of 1 mm to 10 mm before being subjected to the next hydrogen pulverization process. Such a method of making a material alloy by strip casting process is disclosed in U.S. Pat. No. 5,383,978, for example.

Coarse Pulverization Process

Next, the material alloy block that has been coarsely pulverized into flakes is loaded into a hydrogen furnace and then subjected to a hydrogen decrepitation process (which will be sometimes referred to herein as a "hydrogen pulverization process") within the hydrogen furnace. When the hydrogen pulverization process is over, the coarsely pulverized alloy powder is preferably unloaded from the hydrogen furnace in an inert atmosphere so as not to be exposed to the air. This should prevent the coarsely pulverized powder from being oxidized or generating heat and would eventually improve the magnetic properties of the resultant magnet.

As a result of this hydrogen pulverization process, the material alloy of a rare-earth alloy is pulverized to sizes of about 0.1 mm to several millimeters with a mean particle size of 500 μm or less. After the hydrogen pulverization, the decrepitated material alloy is preferably further crushed to finer sizes and cooled. If the material alloy unloaded still has a relatively high temperature, then the alloy should be cooled for a longer time.

Fine Pulverization Process

Next, the coarsely pulverized powder is finely pulverized with a jet mill pulverizing machine. A cyclone classifier is connected to the jet mill pulverizing machine for use in this preferred embodiment. The jet mill pulverizing machine is fed with the rare-earth alloy that has been coarsely pulverized in the coarse pulverization process (i.e., the coarsely pulverized powder) and gets the powder further pulverized by its pulverizer. The powder, which has been pulverized by the pulverizer, is then collected in a collecting tank by way of the cyclone classifier. In this manner, a finely pulverized powder with sizes of about 0.1 μm to about 20 μm (typically 3 μm to 5 μm) can be obtained. The pulverizing machine for use in such a fine pulverization process does not have to be a jet mill but may also be an attritor or a ball mill. Optionally, a lubricant such as zinc stearate may be added as an aid for the pulverization process.

Press Compaction Process

In this preferred embodiment, 0.3 mass % of lubricant is added to, and mixed with, the magnetic powder, obtained by the method described above, in a rocking mixer, thereby coating the surface of the alloy powder particles with the lubricant. Next, the magnetic powder prepared by the method described above is compacted under an aligning magnetic field using a known press machine. The aligning magnetic field to be applied may have a strength of 0.8 to 1.5 MA/m, for example. Also, the compacting pressure is set so that the green compact has a green density of about 4 g/cm$^3$ to about 4.5 g/cm$^3$.

Sintering Process

The powder compact described above is preferably sequentially subjected to the process of maintaining the compact at a temperature of 650° C. to 1000° C. for 10 to 240 minutes and then to the process of further sintering the compact at a higher temperature (of 1000° C. to 1200° C., for example) than in the maintaining process. Particularly when a liquid phase is produced during the sintering process (i.e., when the temperature is in the range of 650° C. to 1000° C.), the R-rich phase on the grain boundary phase starts to melt to produce the liquid phase. Thereafter, the sintering process advances to form a sintered magnet body eventually. The sintered magnet body can also be subjected to the evaporation diffusion process even if its surface has been oxidized as described above. For that reason, the sintered magnet body may be subjected to an aging treatment (at a temperature of 400° C. to 700° C.) or machined to adjust its size.

Hereinafter, a diffusion process to be carried out on the sintered magnet body thus obtained will be described in detail.

RH Diffusion Source

The RH diffusion source may be either a heavy rare-earth element RH, which is at least one of Dy and Tb, or an alloy thereof, and may have any arbitrary shape or size (e.g., in the form of a block or a small piece). If the RH diffusion source is an alloy, the alloy preferably includes 20 at % or more of the heavy rare-earth element RH. Unless the effects of the present invention are lessened, the RH diffusion source may include not only Dy and/or Tb but also an alloy of at least one element selected from the group consisting of Fe, Nd, Pr, La, Ce, Gd, Zn, Sn, Al, Cu, Zr and Co. The RH diffusion source may further include at least one element selected from the group consisting of Ti, V, Cr, Mn, Ni, Ga, Nb, Mo, Ag, In, Hf, Ta, W, Pb, Si and Bi.

To move the point of contact quickly by either rotating or shaking the processing chamber, it is preferred that the surface of the RH diffusion source be curved. Examples of preferred shapes for the RH diffusion source include a sphere, an ellipsoid, and a circular cylinder. Or the RH diffusion source may also have a powder shape such as chips or shavings. Nevertheless, if the RH diffusion source has a powder shape, the powder should not have a lot of powder particles with a particle size of 200 μm or less because sticking would occur easily if the particle size were that small. The RH diffusion source is typically Dy metal or Tb metal, but may also be an alloy including another element. The size of the RH diffusion source may be either smaller or larger than that of the sintered magnet body. However, the size of the RH diffusion source should be defined so that the RH diffusion source can move easily in the processing chamber as the processing chamber is rotated, rocked or shaken.

In a preferred embodiment of the present invention, it is preferred that a stirring aid member, as well as the sintered R-T-B based magnet body and the RH diffusion source, be introduced into the processing chamber. The stirring aid member plays the roles of promoting the contact between the RH diffusion source and the sintered R-T-B based magnet body and indirectly supplying the heavy rare-earth element RH that has been deposited on the stirring aid member itself to the sintered R-T-B based magnet body. Added to that, the stirring aid member also prevents chipping due to a collision between the sintered R-T-B based magnet bodies or between the sintered R-T-B based magnet body and the RH diffusion source in the processing chamber.

The stirring aid member preferably has a shape that makes it easily movable in the processing chamber. And it is effective to rotate, rock or shake the processing chamber by combining that stirring aid member with the sintered R-T-B based magnet body and the RH diffusion source. Such a shape that makes the stirring aid member easily movable may be a sphere, an ellipsoid, or a circular cylinder with a diameter of several hundred μm to several ten mm.

It is preferred that the stirring aid member be made of a material that has almost the same specific gravity as the sintered magnet body and that does not react easily with the sintered R-T-B based magnet body or the RH diffusion source even if the member contacts with the sintered R-T-B based magnet body or the RH diffusion source during the RH diffusion process. The stirring aid member is preferably made of zirconia, silicon nitride, silicon carbide, boron nitride or a ceramic that includes any combination of these compounds. Alternatively, the stirring aid member may also be made of an element belonging to the group including Mo, W, Nb, Ta, Hf and Zr or a mixture thereof.

The stirring aid member may be introduced into the processing chamber before or during the RH diffusion process.

RH Diffusion Process

Hereinafter, an example of a preferred diffusion process according to the present invention will be described with reference to FIG. 1.

In the example illustrated in FIG. 1, sintered R-T-B based magnet bodies 1 and RH diffusion sources 2 have been loaded into a cylinder 3 of stainless steel. In this example, the cylinder 3 functions as the processing chamber. The cylinder 3 does not have to be made of stainless steel but may also be made of any other arbitrary material as long as the material has thermal resistance that is high enough to withstand a temperature of 500° C. to 850° C. and hardly reacts with the sintered R-T-B based magnet bodies 1 or the RH diffusion sources 2. For example, the cylinder 3 may also be made of Nb, Mo, W or an alloy thereof. The cylinder 3 has a cap 5 that can be opened and closed or removed. Optionally, projections may be arranged on the inner wall of the cylinder 3 so that the RH diffusion sources and the sintered magnet bodies can move and contact with each other efficiently. A cross-sectional shape of the cylinder 3 as viewed perpendicularly to its longitudinal direction does not have to be circular but may also be elliptical, polygonal or any other arbitrary shape. In the example illustrated in FIG. 1, the cylinder 3 is connected to an exhaust system 6 such as a pump with a joint. The exhaust system 6 can increase or decrease the pressure inside of the cylinder 3 in the airtight (or hermetically sealed) condition. An inert gas such as Ar may be introduced from a gas cylinder (not shown) into the cylinder 3.

The cylinder 3 is heated by a heater 4, which is arranged around the outer periphery of the cylinder 3. When the cylinder 3 is heated, the sintered R-T-B based magnet bodies 1 and the RH diffusion sources 2 that are housed inside the cylinder 3 are also heated. The cylinder 3 is supported rotatably on its center axis and can also be rotated by a variable motor 7 even while being heated by the heater 4. The rotational velocity of the cylinder 3, which is represented by a surface velocity at the inner wall of the cylinder 3, may be set to be 0.01 m per second or more so as to prevent the sintered R-T-B based magnet bodies 1 and the RH diffusion sources 2 from sticking to each other. The rotational velocity of the cylinder 3 is preferably set to be 0.5 m per second or less so as to prevent the sintered R-T-B based magnet bodies in the cylinder from colliding against each other violently and chipping due to the rotation.

In the example illustrated in FIG. 1, the cylinder 3 is supposed to be rotating. However, according to the present invention, as long as the sintered R-T-B based magnet bodies 1 and the RH diffusion sources 2 are movable relative to each other and can contact with each other in the cylinder 3 so as to avoid sticking to each other, the cylinder 3 does not always have to be rotated but may also be rocked or shaken. Or the cylinder 3 may even be rotated, rocked and/or shaken in combination.

Optionally, another container into which the sintered R-T-B based magnet bodies 1 and the RH diffusion sources 2 have been loaded in advance may be put in its entirety into this cylinder 3. And the number of such a container does not have to be one, but multiple containers may also be put into the cylinder 3 as well.

Next, it will be described how to carry out a diffusion process using the processing apparatus shown in FIG. 1.

First of all, the joint and the cap 5 are removed from the cylinder 3, thereby opening the cylinder 3. And after multiple sintered R-T-B based magnet bodies 1 and RH diffusion sources (RH bulk bodies) 2 have been loaded into the cylinder 3, the joint and the cap 5 are attached to the cylinder 3 again. Then the inner space of the cylinder 3 is evacuated with the exhaust system 6. When the internal pressure of the cylinder 3 becomes sufficiently low, the joint is removed. After that, the cylinder 3 is heated by the heater 4 while being rotated by the motor 7.

During the heat treatment, an inert atmosphere is preferably maintained in the cylinder 3. In this description, the "inert atmosphere" refers to a vacuum or an atmosphere filled with an inert gas. Also, the "inert gas" may be a rare gas such as argon (Ar) gas but may also be any other gas as long as the gas is not chemically reactive between the sintered R-T-B based magnet bodies 1 and the RH diffusion sources 2. The pressure of the inert gas is preferably reduced so as to be lower than the atmospheric pressure. If the pressure of the atmospheric gas inside the cylinder 3 were close to the atmospheric pressure, then the heavy rare-earth element RH would not be supplied easily from the RH diffusion sources 2 onto the surface of the sintered R-T-B based magnet bodies 1 according to the technique disclosed in Patent Document No. 1. However, since the RH diffusion sources and the sintered magnet bodies are arranged either close to, or in contact with, each other, according to the present invention, the amount of the heavy rare-earth element RH diffused can be increased so much that it should be enough to set the pressure of the atmospheric gas inside the cylinder 3 to be 1 kPa or less, for example. That is to say, there is relatively weak correlation between the degree of vacuum and the amount of RH diffused. Thus, even if the degree of vacuum were further increased, the amount of the heavy rare-earth element RH diffused (and eventually the degree of increase in coercivity) would not change significantly. The amount of the heavy rare-earth element RH diffused is sensitive to the temperature of the sintered R-T-B based magnet bodies, rather than the pressure of the atmosphere.

In a preferred embodiment of the present invention, the RH diffusion sources 2 including the heavy rare-earth element RH and the sintered R-T-B based magnet bodies 1 are heated while being rotated together, thereby supplying the heavy rare-earth element RH from the RH diffusion sources onto the surface of the sintered R-T-B based magnet bodies and diffusing the heavy rare-earth element RH inside of the sintered magnet bodies at the same time.

In a preferred embodiment of the present invention, the temperature of the RH diffusion sources and the sintered R-T-B based magnet bodies is maintained within the range of 500° C. to 850° C. This is a preferred temperature range for the heavy rare-earth element RH to diffuse inward in the internal structure of the sintered R-T-B based magnet bodies through the grain boundary phase while the sintered R-T-B based magnet bodies and the RH diffusion sources are moving and contacting with each other in the processing chamber. As a result, the heavy rare-earth element RH can be diffused efficiently inside of the sintered R-T-B based magnet bodies. The amount of time for maintaining that temperature is determined by the ratio of the total volume of the sintered magnet bodies loaded to that of the RH diffusion sources loaded during the RH diffusion process, the shape of the sintered magnet bodies subjected to the RH diffusion process, the shape of the RH diffusion sources, and the rate of diffusion of the heavy rare-earth element RH into the sintered magnet bodies through the RH diffusion process (which will be referred to herein as a "diffusion rate"). The RH diffusion process time may fall within the range of 10 minutes through 72 hours, and is preferably 1 to 12 hours.

In one preferred embodiment, the temperature of the RH diffusion sources and the sintered R-T-B based magnet bodies is maintained within the range of 700° C. to 850° C. for the following reasons.

Specifically, if the process temperature were higher than 850° C., the RH diffusion sources and the sintered magnet bodies would easily stick to each other, which should be avoided. In addition, if the process temperature exceeded 850° C., an excessive amount of the heavy rare-earth element RH would be supplied and a coating consisting mostly of the heavy rare-earth element RH would be formed easily on the surface of the sintered magnet bodies. And if such a coating of the heavy rare-earth element RH were formed, the heavy rare-earth element RH diffusing would reach the core of the main phase crystal grains in the surface region of the magnet bodies as a result of the diffusion process on the magnet bodies. As a result, the magnets eventually have a decreased remanence $B_r$, which is far from a favorable situation.

Nevertheless, if the process temperature were lower than 700° C., the remanence $B_r$ would not decrease and the coercivity $H_{cJ}$ would increase but sometimes it might take a lot of time to get the process done. That is not advantageous in order to achieve high productivity.

The pressure of the atmospheric gas during the RH diffusion process (i.e., the pressure of the atmosphere inside the processing chamber) may be equal to or lower than the atmospheric pressure. The pressure is preferably 100 kPa or less and may be set within the range of $10^{-3}$ to $10^{3}$ Pa, for example.

Optionally, after the RH diffusion process, the sintered R-T-B based magnet bodies 1 may be subjected to an additional heat treatment process in order to distribute more uniformly the heavy rare-earth element RH diffused. In that case, the additional heat treatment process is preferably carried out within the temperature range of 700° C. to 1000° C. with no heavy rare-earth element RH supplied from the RH diffusion sources 2 onto the sintered R-T-B based magnet bodies 1. More preferably, the additional heat treatment process is carried out at a temperature of 850° C. to 950° C. In that additional heat treatment process, no heavy rare-earth element RH is further supplied onto the surface of the sintered R-T-B based magnet bodies 1 but the heavy rare-earth element RH does diffuse inside of the sintered R-T-B based magnet bodies 1. As a result, the heavy rare-earth element RH diffusing can reach deep inside under the surface of the sintered R-T-B based magnet bodies 1, and the magnets as a whole can eventually have increased coercivity. The additional heat treatment process may be carried out for a period of time of 10 minutes to 72 hours, for example, and preferably for 1 to 12 hours. In this case, the pressure of the atmosphere in the heat treatment furnace where the additional heat treatment process is carried out is equal to or lower than the atmospheric pressure and is preferably 100 kPa or less.

Aging Treatment

Also, if necessary, an aging treatment may be further carried out at a temperature of 400° C. to 700° C. However, if the additional heat treatment process needs to be conducted, it is preferred that the aging treatment be carried out after that. The additional heat treatment process and the aging treatment may be performed in the same processing chamber. The aging treatment may be performed for a period of time of 10 minutes to 72 hours, and preferably performed for 1 to 12 hours. In this case, the pressure of the atmosphere in the heat treatment furnace where the aging treatment is carried out is equal to or lower than the atmospheric pressure and is preferably 100 kPa or less.

Experimental Example 1

First of all, a sintered magnet body, having a composition consisting of 29.5 mass % of Nd, 0.5 mass % of Dy, 1.0 mass % of B, 0.9 mass % of Co, 0.1 mass % of Al, 0.1 mass % of Cu, and Fe as the balance, was made. Next, the sintered magnet body was machined, thereby obtaining cubic sintered magnet bodies with a size of 7.4 mm×7.4 mm×7.4 mm. The magnetic properties of the sintered magnet bodies thus obtained were measured with a B—H tracer after the aging treatment (at 500° C.). As a result, the sintered magnet bodies had a coercivity $H_{cJ}$ of 954 kA/m and a remanence $B_r$ of 1.43 T.

Next, those sintered magnet bodies were subjected to an RH diffusion process using the apparatus shown in FIG. 1 under the respective conditions shown in the following Table 1. After having been subjected to the diffusion process, the magnet bodies had each surface thereof ground by 0.2 mm so as to be machined into cubes with a size of 7.0 mm×7.0 mm×7.0 mm. And then their magnetic properties were evaluated.

TABLE 1

| Sample | RH diffusion source | | Rotational velocity (rpm) (surface velocity | RH diffusion temperature | Atmospheric gas pressure | | Additional heat treatment | | $H_{cJ}$ | | $\Delta H_{cJ}$ | |
|---|---|---|---|---|---|---|---|---|---|---|---|---|
| | Shape | Size (mm) | (m/s)) | (° C.) | (Pa) | Sticking | (° C.) | ΔDy | (kA/m) | $B_r$ (T) | (kA/m) | $\Delta B_r$ (T) |
| 1 | Plate | 2 × 10 × 10 | 25 (0.013) | 900 | 0.5 | YES | — | — | — | — | — | — |
| 2 | Plate | 2 × 10 × 10 | 25 (0.013) | 850 | 0.5 | NO | NO | 0.01 | 1094 | 1.43 | 140 | 0 |
| 3 | Cut wire | ø2 × 5 | 5 (0.026) | 750 | 0.5 | NO | NO | 0.01 | 1109 | 1.43 | 155 | 0 |
| 4 | Cut wire | ø2 × 5 | 5 (0.026) | 800 | 0.5 | NO | NO | 0.01 | 1137 | 1.43 | 183 | 0 |

TABLE 1-continued

| Sample | RH diffusion source Shape | RH diffusion source Size (mm) | Rotational velocity (rpm) (surface velocity (m/s)) | RH diffusion temperature (° C.) | Atmospheric gas pressure (Pa) | Sticking | Additional heat treatment (° C.) | ΔDy | $H_{cJ}$ (kA/m) | $B_r$ (T) | $\Delta H_{cJ}$ (kA/m) | $\Delta B_r$ (T) |
|---|---|---|---|---|---|---|---|---|---|---|---|---|
| 5 | Cut wire | ø2 × 5 | 5 (0.026) | 810 | 0.5 | NO | NO | 0.06 | 1166 | 1.43 | 212 | 0 |
| 6 | Cut wire | ø2 × 5 | 5 (0.026) | 820 | 0.5 | NO | NO | 0.07 | 1176 | 1.43 | 222 | 0 |
| 7 | Cut wire | ø2 × 5 | 5 (0.026) | 830 | 0.5 | NO | NO | 0.07 | 1203 | 1.43 | 249 | 0 |
| 8 | Cut wire | ø2 × 5 | 8 (0.042) | 750 | 0.5 | NO | 900 | 0.01 | 1097 | 1.43 | 143 | 0 |
| 9 | Cut wire | ø2 × 5 | 8 (0.042) | 800 | 0.5 | NO | 900 | 0.04 | 1154 | 1.43 | 200 | 0 |
| 10 | Cut wire | ø2 × 5 | 8 (0.042) | 810 | 0.5 | NO | 900 | 0.10 | 1230 | 1.43 | 276 | 0 |
| 11 | Cut wire | ø2 × 5 | 8 (0.042) | 820 | 0.5 | NO | 900 | 0.14 | 1275 | 1.43 | 321 | 0 |
| 12 | Cut wire | ø2 × 5 | 8 (0.042) | 830 | 0.5 | NO | 900 | 0.32 | 1438 | 1.43 | 484 | 0 |
| 13 | Cut wire | ø2 × 5 | 8 (0.042) | 880 | 0.5 | YES | — | — | — | — | — | — |
| 14 | Small piece | 2 × 3 × 0.5 | 25 (0.013) | 750 | 0.5 | NO | NO | 0.01 | 1102 | 1.43 | 148 | 0 |
| 15 | Small piece | 2 × 3 × 0.5 | 25 (0.013) | 750 | 0.5 | NO | 900 | 0.50 | 1490 | 1.42 | 536 | −0.01 |
| 16 | Small piece | 2 × 3 × 0.5 | 25 (0.013) | 700 | 0.5 | NO | NO | 0 | 1062 | 1.43 | 108 | 0 |
| 17 | Small piece | 2 × 3 × 0.5 | 25 (0.013) | 400 | 0.5 | NO | NO | 0 | 950 | 1.43 | 0 | 0 |

Figure 2:
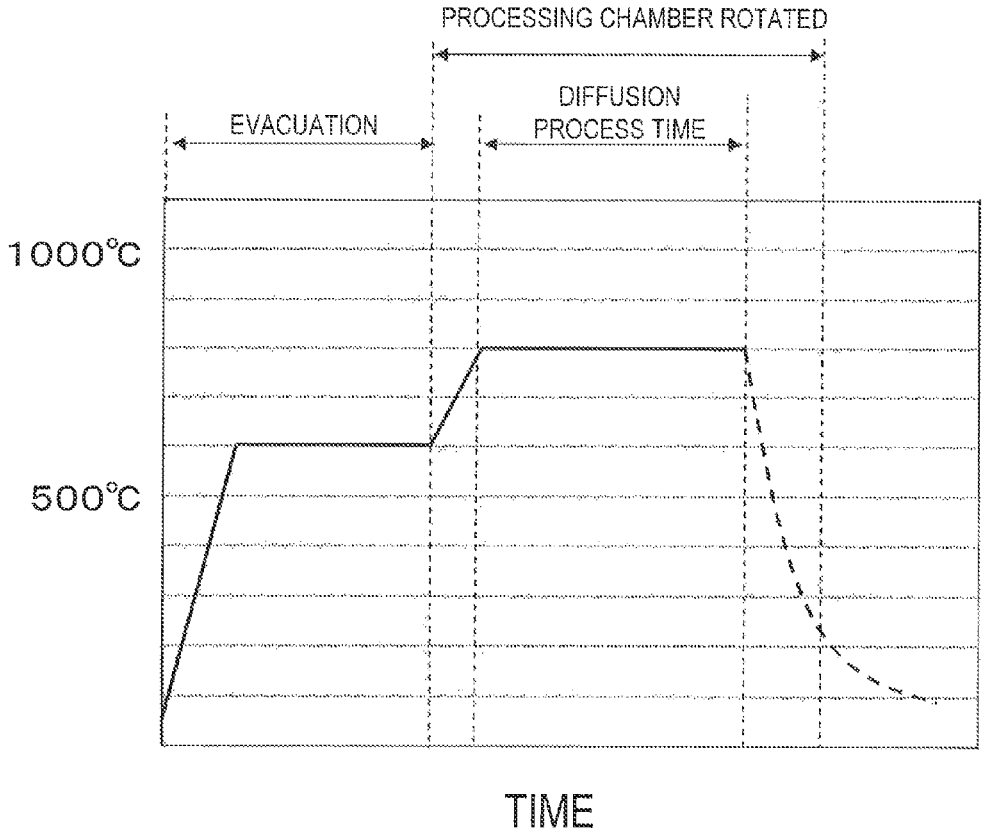
FIG. 2 is a graph showing an example of a heat pattern to adopt in a diffusion process.

In the diffusion process, the temperature in the processing chamber varied as shown in FIG. 2, which is a graph showing a heat pattern that represents how the temperature in the processing chamber varied after the heating process was started. In the example illustrated in FIG. 2, evacuation is carried out while the temperature is being raised by a heater at a temperature increase rate of approximately 10° C. per minute. Next, until the pressure in the processing chamber reaches a predetermined level, the temperature is maintained at about 600° C. Thereafter, the processing chamber starts to be rotated, and the temperature is raised to a diffusion process temperature of 700° C. to 850° C. (e.g., 800° C.) at a temperature increase rate of approximately 3° C. per minute. When the diffusion process temperature is reached, that temperature will be maintained for a predetermined period of time (e.g., two hours in this experimental example). Thereafter, the heating process by the heater is stopped and the temperature is lowered to room temperature. The heat pattern that can be adopted in the diffusion process of the present invention does not have to be the one shown in FIG. 2 but may also be any of various other patterns as well. Optionally, the evacuation process may be carried out until the diffusion process is finished and until the sintered magnet body gets cooled sufficiently.

In Table 1, the "RH diffusion source" column shows the shape and size of the RH diffusion source that was used in the diffusion process. The "rotational velocity" column tells the rotational velocity of the cylinder 3 shown in FIG. 1. The "surface velocity" column indicates the surface velocity at the inner wall of the processing chamber shown in FIG. 1 (i.e., the cylinder 3 with a diameter of 100 mm). The "diffusion temperature" column indicates the temperature in the processing chamber that was maintained for two hours in the diffusion process. The "additional heat treatment process" column says NO if one of the sintered magnet bodies (samples) that were unloaded from the apparatus shown in FIG. 1 was not subjected to the additional heat treatment process but indicates the temperature of the additional heat treatment process if the sample was subjected to the additional heat treatment process. The additional heat treatment process was carried out for two hours. The "Δ Dy" column indicates the difference (i.e., the magnitude of increase) in the Dy content (in mass %) of the sintered magnet body before and after being subjected to the diffusion process. And the "$H_{cJ}$" column indicates the coercivity $H_{cJ}$ of the sample that had been subjected to the diffusion process (or the coercivity $H_{cJ}$ of the sample that had been subjected to the additional heat treatment process). The Δ Dy value was obtained by calculating the difference between the Dy content (mass %) of the overall magnet, of which the propertied had already been evaluated, as measured by ICP analysis and the Dy content (mass %) of the magnet, which had not been subjected to the RH diffusion process yet, as also measured by ICP analysis.

Samples #1 and #2 were subjected to the diffusion process by using a flat Dy plate with a thickness of 2 mm×a length of 10 mm×a width of 10 mm as the RH diffusion source. Samples #3 through #13 were subjected to the diffusion process by using a Dy cut wire with a diameter of 2 mm×a length of 5 mm as the RH diffusion source. And Samples #14 through #17 were subjected to the diffusion process by using a fine piece of Dy with dimensions of 2 mm×3 mm×0.5 mm as the RH diffusion source. As can be seen from Table 1, Samples #2 through #12 and #14 to #16 representing specific examples of the present invention caused almost no decrease in remanence $B_r$, and had their coercivity $H_{cJ}$ increased, compared to what was achieved before the RH diffusion process.

Figure 3:
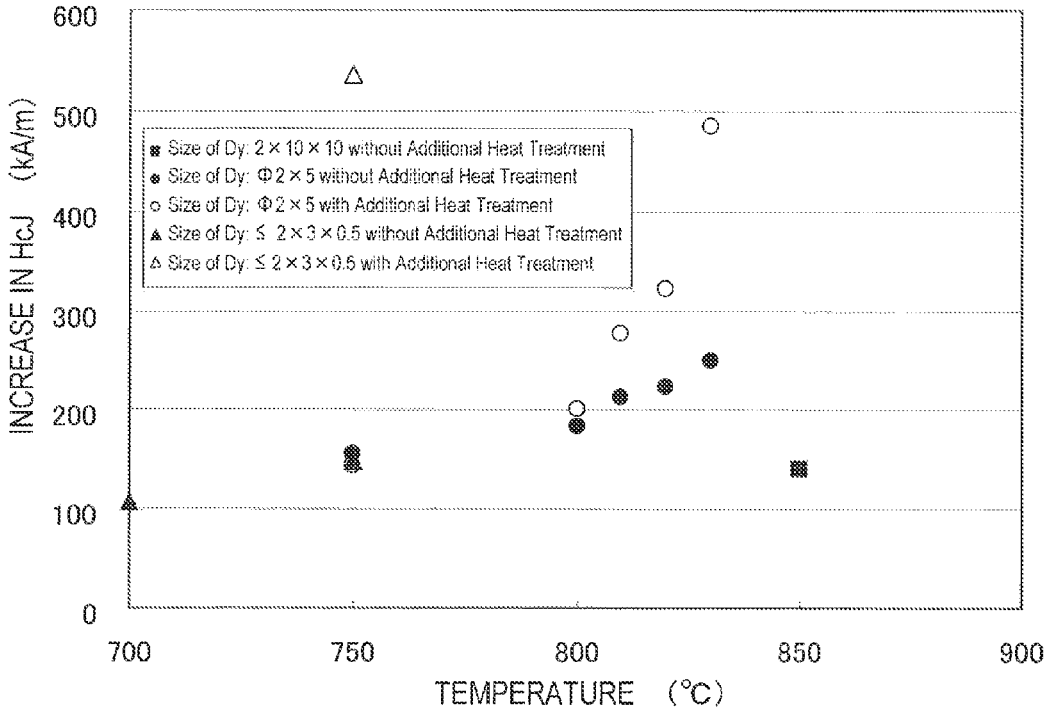
FIG. 3 is a graph showing how the magnitude of increase in coercivity $H_{cJ}$ varied with the diffusion temperature.

FIG. 3 is a graph showing how the magnitude of increase $\Delta H_{cJ}$ in coercivity $H_{cJ}$ varied with the diffusion temperature. In FIG. 3, the ordinate represents the magnitude of increase in coercivity $H_{cJ}$ and the abscissa represents the diffusion temperature. As can be seen from the data shown in FIG. 3, the coercivity increase effect can be confirmed in the temperature range of 700° C. to 850° C. It can also be seen that by performing the additional heat treatment process, the coercivity can be further increased compared to a situation where no additional heat treatment process is carried out. These results reveal that the additional heat treatment process is preferably carried out.

Figure 4:
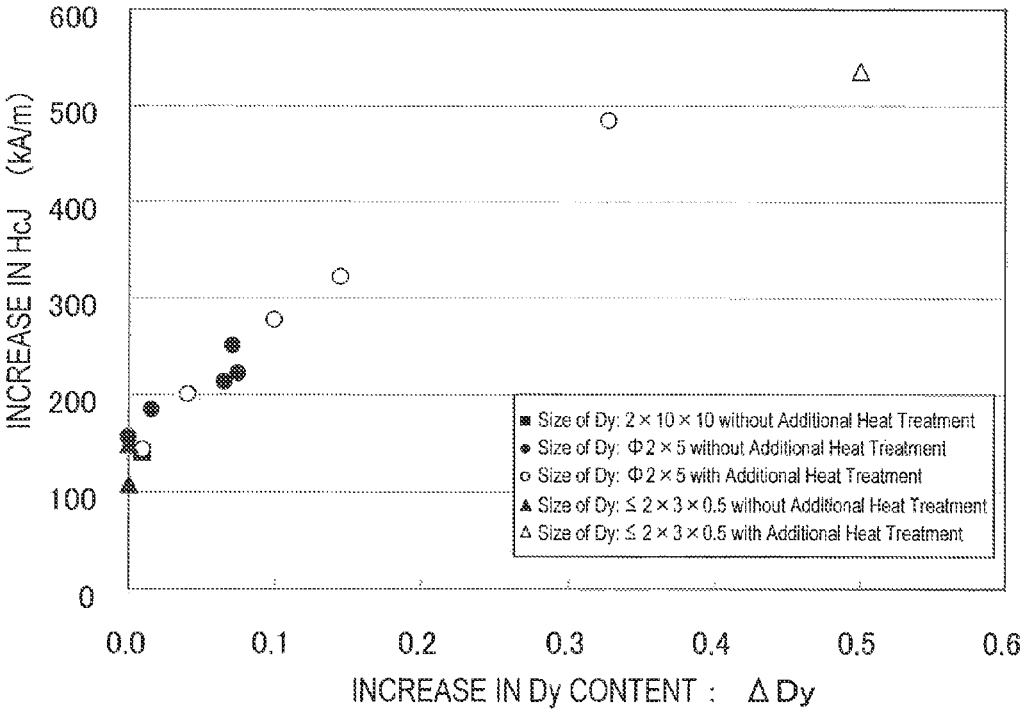
FIG. 4 is a graph showing how the magnitude of increase in coercivity $H_{cJ}$ varied with the increase in Dy content (in mass %) achieved by the diffusion process.

FIG. 4 is a graph showing how the magnitude of increase in coercivity $H_{cJ}$ varied with the increase in Dy content (in mass %) achieved by the diffusion process. In FIG. 4, the ordinate represents the magnitude of increase in coercivity $H_{cJ}$ and the abscissa represents the increase ΔDy in Dy content. As can be seen from the data shown in FIG. 4, as the Dy content increases, the coercivity $H_{cJ}$ increases, too.

For the purpose of comparison, a similar diffusion process was carried out without rotating the processing chamber shown in FIG. 1. As a result, the sintered magnet bodies and the RH diffusion sources stuck to each other. Consequently, the heavy rare-earth element RH could not be diffused uniformly and the sintered magnet bodies fractured or chipped when released from the RH diffusion sources. Also, even if the processing chamber was rotated but if the diffusion temperature was set to be 900° C., the sintered magnet bodies and the RH diffusion sources also stuck to each other.

As can be seen from these results, even if the process temperature is in the range of 700° C. to 850° C., which is usually too low to sublime Dy sufficiently, but if the RH diffusion sources and the sintered magnet bodies are brought into contact with each other in the processing chamber with their point of contact not fixed, Dy can still be introduced effectively into the sintered magnet bodies without causing sticking. As a result, the magnetic properties can be improved.

During the diffusion process, the surface velocity at the inner wall of the processing chamber may be set to be 0.01 m/s or more, for example. If the rotational velocity were too low, the point of contact between the sintered magnet bodies and the RH diffusion sources would shift so slowly as to cause sticking between them easily. That is why the higher the diffusion temperature, the higher the rotational velocity should be. A preferred rotational velocity varies according to not just the diffusion temperature but also the shape and size of the RH diffusion source as well.

Experimental Example 2

First of all, a sintered magnet body, having a composition consisting of 30.0 mass % of Nd, 1.0 mass % of B, 0.9 mass % of Co, 0.1 mass % of Al, 0.1 mass % of Cu, and Fe as the balance, was made. Next, the sintered magnet body was machined, thereby obtaining cubic sintered magnet bodies with a size of 7.4 mm×7.4 mm×7.4 mm. The magnetic properties of the sintered magnet bodies thus obtained were measured with a B—H tracer after the aging treatment (at 500° C.). As a result, the sintered magnet bodies had a coercivity $H_{cJ}$ of 930 kA/m and a remanence $B_r$ of 1.45 T.

Next, those sintered magnet bodies were subjected to an RH diffusion process using the apparatus shown in FIG. 1 under the respective conditions shown in the following Table 2. After having been subjected to the diffusion process, the magnet bodies had each surface thereof ground by 0.2 mm so as to be machined into cubes with a size of 7.0 mm×7.0 mm×7.0 mm. And then their magnetic properties were evaluated.

TABLE 2

| Sample | RH diffusion source | Rotational velocity (rpm) (surface velocity (m/s)) | RH diffusion temperature (° C.) | RH diffusion time (hr) | Atmospheric gas pressure (Pa) | Sticking | Additional heat treatment (° C.) | $H_{cJ}$ (kA/m) | $B_r$ (T) | $\Delta H_{cJ}$ (kA/m) | ΔBr (T) |
|---|---|---|---|---|---|---|---|---|---|---|---|
| 18 | Block 10 × 10 × 10 to 5 × 5× 5 | 5 (0.026) | 800 | 2 | 0.5 | NO | NO | 1128 | 1.45 | 198 | 0 |
| 19 | Block 10 × 10 × 10 to 5 × 5× 5 | 5 (0.026) | 810 | 2 | 0.5 | NO | NO | 1128 | 1.45 | 198 | 0 |
| 20 | Block 10 × 10 × 10 to 5 × 5× 5 | 5 (0.026) | 820 | 2 | 0.5 | NO | NO | 1187 | 1.45 | 257 | 0 |
| 21 | Block 10 × 10 × 10 to 5 × 5× 5 | 5 (0.026) | 800 | 6 | 0.5 | NO | NO | 1279 | 1.45 | 349 | 0 |
| 22 | Block 10 × 10 × 10 to 5 × 5× 5 | 5 (0.026) | 820 | 6 | 0.5 | NO | NO | 1402 | 1.43 | 472 | 0.02 |
| 23 | Block 10 × 10 × 10 to 5 × 5× 5 | 5 (0.026) | 800 | 6 | 0.5 | NO | 900 | 1641 | 1.45 | 711 | 0 |
| 24 | Block 10 × 10 × 10 to 5 × 5× 5 | 5 (0.026) | 900 | 2 | 0.5 | YES | — | — | — | — | — |
| 25 | Block 10 × 10 × 10 to 5 × 5× 5 | 5 (0.026) | 400 | 2 | 0.5 | NO | NO | 928 | 1.45 | −2 | 0 |

In the diffusion process, the temperature in the processing chamber varied as shown in FIG. 2 as in Experimental Example 1 described above. Also, the respective columns of Table 2 show the same kinds of parameters as their counterparts of Table 1. Specifically, the "RH diffusion source" column shows the shape and size of the RH diffusion source that was used in the diffusion process. The "rotational velocity" column tells the rotational velocity (rpm) of the cylinder 3 shown in FIG. 1 and the surface velocity (m/s) at the inner wall of the processing chamber shown in FIG. 1 (i.e., the cylinder 3 with a diameter of 100 mm). The "diffusion temperature" column indicates the temperature in the processing chamber that was maintained for two hours in the diffusion process. The "additional heat treatment process" column says NO if one of the sintered magnet bodies (samples) that were unloaded from the apparatus shown in FIG. 1 was not subjected to the additional heat treatment process but indicates the temperature of the additional heat treatment process if the sample was subjected to the additional heat treatment process. The additional heat treatment process was carried out for two hours. And the "$H_{cJ}$" column indicates the coercivity $H_{cJ}$ of the sample that had been subjected to the diffusion process (or the coercivity $H_{cJ}$ of the sample that had been subjected to the additional heat treatment process).

Samples #18 through #25 were subjected to the diffusion process by using a block of Tb with a thickness of 10 mm×a length of 10 mm×a width of 10 mm to a thickness of 5 mm×a length of 5 mm×a width of 5 mm as the RH diffusion source. As can be seen from Table 2, Samples #18 through #23 representing specific examples of the present invention caused almost no decrease in remanence $B_r$, and had their coercivity $H_{cJ}$ increased, compared to what was achieved before the RH diffusion process.

Figure 5:
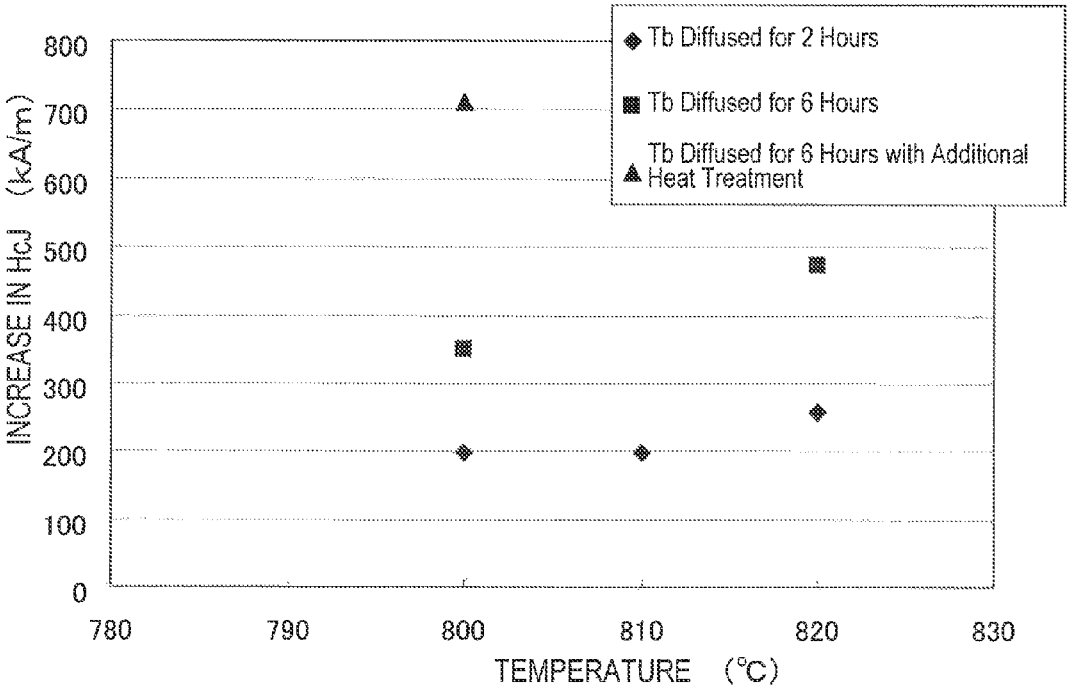
FIG. 5 is a graph showing how the magnitude of increase in coercivity $H_{cJ}$ varied with the diffusion temperature.

FIG. 5 is a graph showing how the magnitude of increase in coercivity $H_{cJ}$ varied with the diffusion temperature. In FIG.

5, the ordinate represents the magnitude of increase h coercivity $H_{cJ}$ and the abscissa represents the diffusion temperature. As can be seen from the data shown in FIG. 5, the coercivity increase effect can be confirmed in the temperature range of 800° C. to 820° C. It can also be seen that by performing the additional heat treatment process, the coercivity can be further increased compared to a situation where no additional heat treatment process is carried out.

As can be seen from these results, even if the process temperature is in the range of 800° C. to 820° C., which is usually too low to sublime Tb sufficiently, but if the RH diffusion sources and the sintered magnet bodies are brought into contact with each other in the processing chamber with their point of contact not fixed, Tb can still be introduced effectively into the sintered magnet bodies without causing sticking. As a result, the magnetic properties can be improved.

Experimental Example 3

The sintered magnet bodies that were obtained in Experimental Example 1 described above were subjected to the RH diffusion process under the same conditions as in Experimental Example 1 except the ones shown in the following Table 3. After having been subjected to the diffusion process, the sintered magnet bodies had each surface thereof ground by 0.2 mm so as to be machined into cubes with a size of 7.0 mm×7.0 mm×7.0 mm. And then their magnetic properties were evaluated with a B—H tracer. As a result, even in Samples #26 and #27 with RH diffusion process temperatures of 500° C. and 600° C., respectively, the remanence $B_r$ hardly decreased from what was achieved before the RH diffusion process and the coercivity $H_{cJ}$ increased.

TABLE 3

| Sample | RH diffusion source Shape | Size (mm) | Rotational velocity (rpm) (surface velocity (m/s)) | RH diffusion temperature (° C.) | Atmospheric gas pressure (Pa) | Sticking | Additional heat treatment (° C.) | ΔDy | $H_{cJ}$ (kA/m) | $B_r$ (T) | $\Delta H_{cJ}$ (kA/m) | $\Delta B_r$ (T) |
|---|---|---|---|---|---|---|---|---|---|---|---|---|
| 26 | Small piece | 2 × 3 × 0.5 | 25 (0.013) | 600 | 0.5 | NO | NO | 0 | 1019 | 1.43 | 65 | 0 |
| 27 | Small piece | 2 × 3 × 0.5 | 25 (0.013) | 500 | 0.5 | NO | NO | 0 | 995 | 1.43 | 41 | 0 |

Experimental Example 4

First of all, a sintered R-T-B based magnet body, having a composition consisting of 30.0 mass % of Nd, 0.5 mass % of Dy, 1.0 mass % of B, 0.9 mass % of Co, 0.1 mass % of Al, 0.1 mass % of Cu, and Fe as the balance, was made. Next, the sintered magnet body was machined, thereby obtaining cubic sintered R-T-B based magnet bodies with a size of 7.4 mm×7.4 mm×7.4 mm. The magnetic properties of the sintered R-T-B based magnet bodies thus obtained were measured with a B—H tracer after the aging treatment (at 400° C.). As a result, the sintered magnet bodies had a coercivity $H_{cJ}$ of 1000 kA/m and a remanence $B_r$ of 1.42 T.

Next, the RH diffusion process was carried out using the apparatus shown in FIG. 1. In this case, the cylinder had a volume of 128000 $mm^3$, the total weight (or the number of) the sintered R-T-B based magnets loaded was 50 g (five), and the total weight of the RH diffusion sources loaded was also 50 g. Each of the RH diffusion sources used had a diameter of mm or less. After the diffusion process, the aging treatment was carried out on no sintered magnet bodies.

In the diffusion process, evacuation is carried out on the processing chamber while the temperature is being raised by a heater at a temperature increase rate of approximately 10° C. per minute. Next, until the pressure in the processing chamber reaches a predetermined level, the temperature is maintained at about 600° C. Thereafter, the processing chamber starts to be rotated, and the temperature is raised to a diffusion process temperature at a temperature increase rate of approximately 10° C. per minute. When the diffusion process temperature is reached, that temperature will be maintained. Thereafter, the heating process by the heater is stopped and the temperature is lowered to room temperature. After that, the sintered magnet bodies that have been unloaded from the apparatus shown in FIG. 1 are loaded into another heat treatment furnace, where the sintered magnet bodies are subjected to an additional heat treatment process (at a temperature of 700° C. to 900° C. for 4 to 6 hours) at the same atmospheric gas pressure as in the diffusion process and then subjected to a post-diffusion aging treatment (at a temperature of 450° C. to 550° C. for 3 to 5 hours). In this case, the process temperatures and process times of the additional heat treatment process and the aging treatment are set based on the total volumes of the sintered R-T-B based magnet bodies and RH diffusion sources loaded, the composition of the RH diffusion sources, the RH diffusion temperature and other factors.

The RH diffusion process was carried out using multiple RH diffusion sources with the contents of Dy, Tb and Fe varied. The properties achieved as a result are those of Samples #28 through #43 shown in the following Table 4:

TABLE 4

| Sample | RH diffusion source Dy (mass %) | Tb | Fe | Size (mm) | Surface velocity (m/s) | RH diffusion temperature (° C.) | RH diffusion time (hr) | Atmospheric pressure (Pa) | $\Delta H_{cJ}$ (kA/m) | $\Delta B_r$ (T) |
|---|---|---|---|---|---|---|---|---|---|---|
| 28 | 70 | 0 | 30 | ≤3 | 0.02 | 850 | 12 | 0.5 | 344 | −0.005 |
| 29 | 60 | 0 | 40 | ≤3 | 0.02 | 850 | 12 | 0.5 | 344 | 0 |
| 30 | 60 | 0 | 40 | ≤3 | 0.02 | 820 | 12 | 0.5 | 275 | 0 |

TABLE 4-continued

| Sample | RH diffusion source Dy (mass %) | Tb | Fe | Size (mm) | Surface velocity (m/s) | RH diffusion temperature (° C.) | RH diffusion time (hr) | Atmospheric pressure (Pa) | $\Delta H_{cJ}$ (kA/m) | $\Delta B_r$ (T) |
|---|---|---|---|---|---|---|---|---|---|---|
| 31 | 60 | 0 | 40 | ≤3 | 0.02 | 800 | 12 | 0.5 | 220 | 0 |
| 32 | 60 | 0 | 40 | ≤3 | 0.02 | 850 | 6 | 0.5 | 200 | 0 |
| 33 | 60 | 0 | 40 | ≤3 | 0.02 | 850 | 12 | 100 | 336 | 0 |
| 34 | 60 | 0 | 40 | ≤3 | 0.02 | 850 | 12 | 100000 | 312 | 0 |
| 35 | 50 | 0 | 50 | ≤3 | 0.02 | 850 | 12 | 0.5 | 328 | 0 |
| 36 | 55 | 0 | 45 | ≤3 | 0.02 | 820 | 12 | 0.5 | 240 | 0 |
| 37 | 55 | 0 | 45 | ≤3 | 0.02 | 750 | 12 | 0.5 | 40 | 0 |
| 38 | 40 | 0 | 60 | ≤3 | 0.02 | 850 | 12 | 0.5 | 328 | 0 |
| 39 | 25 | 0 | 75 | ≤3 | 0.02 | 850 | 12 | 0.5 | 160 | 0 |
| 40 | 20 | 0 | 80 | ≤3 | 0.02 | 850 | 12 | 0.5 | 144 | 0 |
| 41 | 0 | 60 | 40 | ≤3 | 0.02 | 850 | 12 | 0.5 | 585 | 0 |
| 42 | 30 | 30 | 40 | ≤3 | 0.02 | 850 | 12 | 0.5 | 469 | 0 |
| 43 | 80 | 0 | 20 | ≤5 | 0.02 | 820 | 6 | 0.5 | 300 | −0.01 |

As can be seen from this Table 4, it took a longer time to get the RH diffusion process done than in Experimental Example 1 or 2 except Sample #43. However, it can also be seen that even when an RH diffusion source including a heavy rare-earth element RH and Fe was used, a decrease in remanence could also be minimized and the coercivity also increased. In addition, the results obtained for Samples #33 and #34 reveal that even if the pressure of the atmospheric gas was high, the effects of the present invention could still be achieved. Furthermore, no sticking occurred at all between the sintered magnet bodies and the RH diffusion sources in any of Samples #28 through #43.

TABLE 5

| Sample | RH diffusion source Dy (mass %) | Tb | Fe | Size (mm) | Surface velocity (m/s) | RH diffusion temperature (° C.) | RH diffusion time (hr) | Atmospheric pressure (Pa) | $\Delta H_{cJ}$ (kA/m) | $\Delta B_r$ (T) | Stirring aid member |
|---|---|---|---|---|---|---|---|---|---|---|---|
| 44 | 70 | 0 | 30 | ≤3 | 0.02 | 850 | 6 | 0.5 | 344 | −0.005 | YES |
| 45 | 60 | 0 | 40 | ≤3 | 0.02 | 850 | 6 | 0.5 | 344 | 0 | YES |
| 46 | 60 | 0 | 40 | ≤3 | 0.02 | 850 | 6 | 2 | 336 | 0 | YES |
| 47 | 60 | 0 | 40 | ≤3 | 0.02 | 850 | 6 | 100000 | 312 | 0 | YES |
| 48 | 55 | 0 | 45 | ≤3 | 0.02 | 820 | 4 | 0.5 | 190 | 0 | YES |
| 49 | 50 | 0 | 50 | ≤3 | 0.02 | 850 | 6 | 0.5 | 328 | 0 | YES |
| 50 | 40 | 0 | 60 | ≤3 | 0.02 | 850 | 6 | 0.5 | 320 | 0 | YES |
| 51 | 40 | 0 | 60 | ≤3 | 0.02 | 850 | 3 | 0.5 | 200 | 0 | YES |
| 52 | 25 | 0 | 75 | ≤3 | 0.02 | 850 | 6 | 0.5 | 163 | 0 | YES |
| 53 | 20 | 0 | 80 | ≤3 | 0.02 | 850 | 6 | 0.5 | 142 | 0 | YES |
| 54 | 0 | 60 | 40 | ≤3 | 0.02 | 850 | 12 | 0.5 | 585 | 0 | YES |
| 55 | 30 | 30 | 40 | ≤3 | 0.02 | 850 | 6 | 0.5 | 465 | 0 | YES |
| 56 | 80 | 0 | 20 | ≤5 | 0.02 | 820 | 3 | 0.5 | 290 | −0.01 | YES |

Experimental Example 5

The RH diffusion process was carried out as in Experimental Example 4 described above except that a sphere of zirconia with a diameter of 5 mm and a weight of 50 g was used as a stirring aid member. The results are shown in the following Table 5. As can be seen from Table 5, even though the RH diffusion process was carried out on Samples #44, #45, #47, #49, #50 and #52 through #56 for only a half as long a time as on Samples #28, #29, #34, #35, and #39 through #43, almost the same properties were achieved. The results obtained by Samples #46 and #47 reveal that the effects of the present invention were achieved even when the atmospheric gas pressure was high. Also, the results obtained by Sample #44 in Table 5 and Sample #28 in Table 4 reveal that $H_{cJ}$ could be increased in a shorter time with a sphere of zirconia with a diameter of 5 mm introduced. This is probably because the sphere of zirconia functioning as a stirring aid member would have promoted contact between the RH diffusion sources and the sintered magnet bodies and would have supplied the heavy rare-earth element RH that had been deposited on itself onto the sintered magnet bodies indirectly. On top of that, chipping occurred much less often than in Samples #28, #29, #34, #35, and #39 through #43.

Experimental Example 6

First of all, as in Experimental Example 4 described above, a sintered R-T-B based magnet body, having a composition consisting of 30.0 mass % of Nd, 0.5 mass % of Dy, 1.0 mass % of B, 0.9 mass % of Co, 0.1 mass % of Al, 0.1 mass % of Cu, and Fe as the balance, was made. Next, the sintered magnet body was machined, thereby obtaining cubic sintered R-T-B based magnet bodies with a size of 7.4 mm×7.4 mm×7.4 mm. The magnetic properties of the sintered R-T-B based magnet bodies thus obtained were measured with a B—H tracer after the aging treatment (at 400° C.). As a result, the sintered magnet bodies had a coercivity $H_{cJ}$ of 1000 kA/m and a remanence $B_r$ of 1.42 T.

Next, the RH diffusion process was carried out using the apparatus shown in FIG. 1. In this case, the cylinder had a volume of 128000 $mm^3$, the total weight (or the number of) the sintered R-T-B based magnets loaded was 50 g (five), and the total weight of the RH diffusion sources loaded was also 50 g. Each of the RH diffusion sources used was a spherical one with a diameter of 3 mm or less. The RH diffusion process was carried out using a sphere of zirconia with a diameter of 5 mm and a weight of 50 g as a stirring aid member.

In the diffusion process, evacuation is carried out on the processing chamber while the temperature is being raised by a heater at a temperature increase rate of approximately 10° C. per minute. Next, until the pressure in the processing chamber reaches a predetermined level, the temperature is maintained at about 600° C. Thereafter, the processing chamber starts to be rotated, and the temperature is raised to a diffusion process temperature at a temperature increase rate of approximately 10° C. per minute. When the diffusion process temperature is reached, that temperature will be maintained. Thereafter, the heating process by the heater is stopped and the temperature is lowered to room temperature. After that, the sintered magnet bodies that have been unloaded from the apparatus shown in FIG. 1 are loaded into another heat treatment furnace, where the sintered magnet bodies are subjected to an additional heat treatment process (at a temperature of 700° C. to 900° C. for 4 to 6 hours) at the same atmospheric gas pressure and for the same period of time as in the diffusion process and then subjected to a post-diffusion aging treatment (at a temperature of 450° C. to 550° C. for 3 to 5 hours). In this case, the process temperatures and process times of the additional heat treatment process and the aging treatment are set based on the total volumes of the sintered R-T-B based magnet bodies and RH diffusion sources loaded, the composition of the RH diffusion sources, the RH diffusion temperature and other factors.

When the RH diffusion process was carried out using RH diffusion sources in which another metal was added to Dy or Tb, the results obtained were those of Samples #57 through #79 shown in the following Table 6.

TABLE 6

| Sample | RH diffusion source: Composition (mass %) | RH diffusion source: Size (mm) | Surface velocity (m/s) | RH diffusion temperature (° C.) | RH diffusion time (hr) | Atmospheric gas pressure (Pa) | $\Delta H_{cJ}$ (kA/m) | $\Delta B_r$ (T) |
|---|---|---|---|---|---|---|---|---|
| 57 | 80Dy-20Co | ≤3 | 0.02 | 700 | 6 | 0.5 | 258 | 0 |
| 58 | 70Dy-30Cu | ≤3 | 0.02 | 700 | 6 | 0.5 | 185 | 0 |
| 59 | 60Tb-40Co | ≤3 | 0.02 | 700 | 6 | 0.5 | 400 | 0 |
| 60 | 40Dy-60Co | ≤3 | 0.02 | 800 | 6 | 0.5 | 275 | 0 |
| 61 | 80Dy-20Nd | ≤3 | 0.02 | 800 | 6 | 0.5 | 200 | 0 |
| 62 | 80Dy-20Pr | ≤3 | 0.02 | 800 | 6 | 0.5 | 210 | 0 |
| 63 | 90Dy-10Zn | ≤3 | 0.02 | 800 | 6 | 0.5 | 320 | 0 |
| 64 | 95Tb-5Cu | ≤3 | 0.02 | 800 | 6 | 100 | 600 | -0.005 |
| 65 | 97Dy-3Zn | ≤3 | 0.02 | 800 | 6 | 100000 | 240 | 0 |
| 66 | 40Dy-40Ce-20Co | ≤3 | 0.02 | 700 | 6 | 0.5 | 150 | 0 |
| 67 | 70Dy-10Nd-20Co | ≤3 | 0.02 | 700 | 6 | 0.5 | 200 | 0 |
| 68 | 65Dy-10Nd-10Pr-15Co | ≤3 | 0.02 | 700 | 6 | 0.5 | 180 | 0 |
| 69 | 50Dy-20La-20Ce-10Co | ≤3 | 0.02 | 700 | 6 | 0.5 | 160 | 0 |
| 70 | 53Dy-8Nd-7Pr-12Fe-20Co | ≤3 | 0.02 | 700 | 6 | 0.5 | 200 | 0 |
| 71 | 30Tb-10Ce-5Nd-5Pr-50Co | ≤3 | 0.02 | 850 | 6 | 0.5 | 230 | 0 |
| 72 | 50Dy-5Gd-5Ce-40Fe | ≤3 | 0.02 | 850 | 6 | 0.5 | 170 | 0 |
| 73 | 45Dy-10Nd-8Pr-35Fe-2Zn | ≤3 | 0.02 | 800 | 6 | 0.5 | 200 | 0 |
| 74 | 40Dy-8Nd-10Pr-10Ce-10La-20Fe-2Cu | ≤3 | 0.02 | 820 | 6 | 0.5 | 180 | 0 |
| 75 | 60Dy-37Fe-1Ga-1Cu-1Ni | ≤3 | 0.02 | 830 | 6 | 0.5 | 250 | 0 |
| 76 | 30Tb-15Dy-10Ce-5La-30Fe-2V-3Cu-2Zr-2Mn-1Al | ≤3 | 0.02 | 850 | 6 | 0.5 | 160 | 0 |
| 77 | 10Tb-25Dy-5Gd-10Ce-35Fe-2Nb-2W-3Cr-5Mn-1Si-2Cu | ≤3 | 0.02 | 850 | 6 | 0.5 | 180 | 0 |
| 78 | 40Dy-10La-15Ce-10Co-8Fe-5Cu-3Ta-2Mo-3Sn-3Ag-1In | ≤ | 0.02 | 820 | 6 | 0.5 | 170 | 0 |
| 79 | 50Dy-23Fe-5Zn-7Ti-2Bi-3Hf-3Au-4Mo-3Al | ≤5 | 0.02 | 820 | 6 | 0.5 | 190 | 0 |

As can be seen from the results shown in Table 6, even when such RH diffusion sources in which another metal was added to Dy or Tb were used for Samples #57 through #79, the decrease in remanence could also be minimized and the coercivity could be increased.

INDUSTRIAL APPLICABILITY

According to the present invention, a sintered R-T-B based magnet can be produced so that its remanence and coercivity are both high as a whole. Thus, the present invention can be used effectively in various types of motors such as a motor for a hybrid car to be exposed to high temperatures and in numerous kinds of consumer electronic appliances.

REFERENCE SIGNS LIST

1 sintered R-T-B based magnet body
2 RH diffusion source
3 cylinder made of stainless steel (processing chamber)
4 heater
5 cap
6 exhaust system

The invention claimed is:

1. A method for producing a sintered R-T-B based magnet, the method comprising the steps of:

providing a sintered R-T-B based magnet body;

providing an RH diffusion source including a metal or an alloy of a heavy rare-earth element RH, which is at least one selected from the group consisting of Dy and Tb;

loading the sintered R-T-B based magnet body and the RH diffusion source into a processing chamber so that the sintered R-T-B based magnet body and the RH diffusion source are moved into contact with each other or into and out of contact with each other;

performing an RH diffusion process by conducting a heat treatment on the sintered R-T-B based magnet body and the RH diffusion source at a temperature of 500° C. to 850° C. for at least 10 minutes by heating the processing chamber while moving the sintered R-T-B based magnet body and the RH diffusion source either continuously or discontinuously in the processing chamber so that the magnet body and the RH diffusion source are moved into contact with each other at least once or into and out of contact with each other at least once by rotating the processing chamber at a surface velocity of at least 0.01 m/s. and changing a point of contact between the sintered R-T-B based magnet body and the RH diffusion source and supplying the heavy rare-earth element RH from the RH diffusion source to the sintered R-T-B based magnet body via the point of contact between the sintered R-T-B based magnet body and the RH diffusion source; and introducing a stirring aid member into the processing chamber before or during the RH diffusion process, the stirring aid member being made of zirconia, silicon nitride, silicon carbide, boron nitride, or any combination thereof; wherein in the RH diffusion process, the processing chamber is heated by a heater that is arranged around an outer periphery of the processing chamber, the sintered R-T-B based magnet body and the RH diffusion source that are loaded into the processing chamber are also heated, and the temperature of the sintered R-T-B based magnet body and the RH diffusion source is maintained within a range of 500° C. to 850° C.

2. The method of claim 1, wherein in the RH diffusion process, the heat treatment is carried out with an internal pressure of the processing chamber adjusted to 100 kPa or less.

3. The method of claim 1, wherein the RH diffusion source has a shape of a sphere, an ellipsoid, or a circular cylinder.

4. A method for producing a sintered R-T-B based magnet, the method comprising the steps of:

providing a sintered R-T-B based magnet body;

providing an RH diffusion source including a metal or an alloy of a heavy rare-earth element RH, which is at least one selected from the group consisting of Dy and Tb;

loading the sintered R-T-B based magnet body and the RH diffusion source into a processing chamber so that the sintered R-T-B based magnet body and the RH diffusion source are movable relative to each other and brought into contact with each other;

performing an RH diffusion process by conducting a heat treatment on the sintered R-T-B based magnet body and the RH diffusion source at a temperature of 500° C. to 850° C. for at least 10 minutes by heating the processing chamber while moving the sintered R-T-B based magnet body and the RH diffusion source either continuously or discontinuously in the processing chamber by rotating the processing chamber at a surface velocity of at least 0.01 m/s, and changing a point of contact between the sintered R-T-B based magnet body and the RH diffusion source and supplying the heavy rare-earth element RH from the RH diffusion source to the sintered R-T-B based magnet body via the point of contact between the sintered R-T-B based magnet body and the RH diffusion source, and the heavy rare-earth element RH that is vaporized from the RH diffusion source is also supplied onto a surface of the sintered R-T-B based magnet body;

introducing a stirring aid member into the processing chamber before or during the RH diffusion process, the stirring aid member being made of zirconia, silicon nitride, silicon carbide, boron nitride, or any combination thereof; wherein in the RH diffusion process, the processing chamber is heated by a heater that is arranged around an outer periphery of the processing chamber, the sintered R-T-B based magnet body and the RH diffusion source that are loaded into the processing chamber are also heated, and the temperature of the sintered R-T-B based magnet body and the RH diffusion source is maintained within a range of 500° C. to 850° C.

5. The method of claim 4, wherein in the RH diffusion process, the heat treatment is carried out with an internal pressure of the processing chamber adjusted to 100 kPa or less.

* * * * *